United States Patent [19]

Maisonneuve

[11] 4,062,200

[45] Dec. 13, 1977

[54] CONTAINER DISPENSING DEVICE

[76] Inventor: Leo V. Maisonneuve, 4480 N. 40th St., St. Petersburg, Fla. 33714

[21] Appl. No.: 730,979

[22] Filed: Oct. 8, 1976

[51] Int. Cl.[2] ..... F25B 1/00; B26D 7/10; B65H 1/08; G07F 11/16

[52] U.S. Cl. ..... 62/320; 83/170; 221/227

[58] Field of Search ..... 62/457, 531, 371, 372, 62/331, 320, 321; 83/170 X; 221/22, 23, 227 X

[56] References Cited

U.S. PATENT DOCUMENTS

| | | | |
|---|---|---|---|
| 1,583,637 | 5/1926 | Wilson | 83/170 |
| 1,768,693 | 7/1930 | Kaskouras | 62/320 |
| 1,779,341 | 10/1930 | Stieber | 62/320 |
| 1,810,226 | 6/1931 | Shaw et al. | 83/170 |
| 2,056,711 | 10/1936 | Christoplos | 62/320 |
| 2,122,947 | 5/1938 | Lopez | 62/320 |
| 2,554,953 | 5/1951 | Moster | 62/320 |

*Primary Examiner*—Lloyd L. King
*Attorney, Agent, or Firm*—Arthur W. Fisher, III

[57] ABSTRACT

A portable dispenser for loading, storing, cooling, and cutting cube stick foodstuffs such as butter or the like. The portable dispenser comprises a body having a top and base detachably attached to opposite ends thereof and a thermal unit in which to place the portable dispenser when not being used to slice pats therefrom to keep the cube stick cold. The body comprises a receptacle to retain the cube stick, a positioning mechanism which when actuated by positive force from the operator causes a pressure plate to press downwardly on the cube stick, to push it a precise distance into the base wherein a cutter wire simultaneously slices a pat from the cube stick. The positioning mechanism and cutter wire are both operated by an actuator lever with a fulcrum at its midpoint. On the upper end, a positioning actuator operates the positioning mechanism while, simultaneously, a cutter actuator on the lower end operates the cutter wire. The sides of the receptacle housing are convexedly curved so that the cube stick squeezes between the two sides and is held securely in place so that it can be picked up without being touched by human hands. A support ledge below the top is shaped substantially the same as the neck of the cooler so that the support ledge fits snugly therein and forms the top of the cooler.

16 Claims, 12 Drawing Figures

CONTAINER DISPENSING DEVICE

BACKGROUND OF THE INVENTION

1. Field of the Invention

A portable dispenser for loading, storing, cooling, and cutting cube stick foodstuffs such as butter and the like.

2. Prior Art

Wherever butter is used, it is commonly served in individual pats. The homeowner has in the past followed the procedure of manually cutting a pat of the size desired with the use of a knife and butter dish. Restaurants must either cut the butter in pats themselves or obtain the butter from a supplier in that form.

A butter dispensing device should not only cut and dispense butter in pats of the size desired but should also maintain the butter at a predetermined temperature. In addition, the operating mechanism of the device should be simple to operate and should permit ready disassembly for cleaning and servicing.

The basic principle utilized in cutting and dispensing devices of this nature is the movement of cutting means, such as a wire or the like, transversely to a stick of butter. The mechanisms employed to accomplish this have been extremely complicated devices which would not be readily adaptable to widespread use. The butter cutting and dispensing mechanism should be extremely simple and effective and should be capable of quick assembly. In addition, it is preferable that the cutting and dispensing mechanism comprise as few parts as possible in order to permit ready reassembly of the device by personnel who are not mechanically trained.

Moreover, none of the prior art includes any sanitary means of placing the spread into the device. In the present state of the art, it is a sticky and messy process for the operator to take an unwrapped bar of spread in his hands and place it in the spread housing or receptacle. A need exists for such a device which permits the butter or foodstuff to be placed in the device and dispensed without ever being touched by human hands.

The prior art also includes coolers permanently interconnected with the dispensing devices. There are also portable coolers on the market into which the dispensing device can be placed for cooling. But there are no such coolers wherein a structural member of the top of the dispensing device forms the top of the cooler as will be described in the description of this invention.

SUMMARY OF THE INVENTION

This invention relates to a portable dispenser for loading, storing, cooling, and cutting cube stick foodstuffs such as butter or the like.

The portable dispenser comprises a body having a top and a base detachably attached thereto and a thermal unit into which the portable dispenser can be placed to keep the cube stick cool and sanitary when not being used to slice pats.

The body comprises a receptacle for holding the cube stick therein, a positioning mechanism which presses down on the cube stick by means of a pressure plate and forces it a precise distance into the base where a cutter wire simultaneously slices it, a support ledge to which the top is detachably attached, and an actuator.

The receptacle comprises a receptacle plate and a receptacle housing. The receptacle housing forms three sides of the receptacle. It has convex spaced apart sides slightly less than the width of a side of a cube stick at their closest point. When the receptacle housing is attached to the body, the receptacle plate forms the fourth wall of the receptacle. Each of the four walls of the receptacle are curved so that air spaces are formed between them and the cube stick to provide maximum insulation even when the dispenser is being operated. The pressure plate, being hollow, also acts as an insulator.

The bottom of the receptacle terminates in a cutting aperture in the base for the cube stick to pass therethrough. As the cube stick passes therein, it is sliced by the cutter wire and the resulting pat falls out the bottom of the base to be utilized.

The cube stick is fed into the base in precise thicknesses by means of the positioning mechanism, which comprises the pressure plate, a pair of pressure plate posts which are located in the respective actuator tubes stationed to the rear of the receptacle plate and which extend the full length of the receptacle, and a pair of pressure plate arms which connect the pressure plate to the respective pressure plate posts. Pressure plate slots are contained in the actuator tubes to permit the pressure plate arms to pass therethrough.

Contained above the pressure plate posts in the actuator tubes is a plurality of positioning elements such as ball bearings, one on top of the other. These positioning elements are fed into the actuator tubes from a pair of positioning element reservoirs in the top.

The actuator comprises an actuator lever operated by means of a fulcrum near the vertical center and at the rear of the body, a cutter actuator at the bottom of the actuator lever, a positioning actuator at the top of the actuator lever, the positioning elements, and an actuator spring.

During operation, the positioning actuator which consists of two prongs, moves in and out of the actuator tubes by means of slots therein. Full movement of the prongs therein forces the positioning elements down, forcing the pressure plate posts and the pressure plate downward, which in turn force the cube stick down a specific distance equal to the thickness of the desired pat.

As the positioning actuator forces the cube stick downward, the cutter actuator pulls the cutter wire by means of the cutting element across the cube stick so that a pat is sliced.

The cutting element comprises a cutter holder and the cutter wire attached thereto. The cutter holder comprises a pair of flexible arms to which the cutter wire is attached at the forward ends thereof, a support member attached to the rear ends of the arms, and a cutting element retainer which attaches the cutting element to the cutter actuator at a specified angle.

While the cutter actuator is pulling the cutter wire across the cube stick, the guide elements on the forward ends of the cutter holder arms ride in cutting element grooves contained in a pair of guide members located on the inside surfaces of the sides of the base. The difference in height of the grooves from the forward end to the rear end is equal to the thickness of the desired pat. Since the positioning actuator and the cutter actuator are interconnected by means of the fulcrum and the various related parts are constructed to move proportionately, the cutter wire moves down at the same rate that the cube stick moves down as it moves across and slices it. Thus, the desired pat of the cube stick is obtained.

When the operator turns loose of the actuator lever, a spring attached at the fulcrum returns it to the starting position. As the cutter actuator is returned to the starting position, the arms ride under the guide members. As the starting position is reached, the guide elements spring back into the grooves.

When not being used to slice pats, the portable dispenser is stored in the thermal unit so that the cube stick will be kept cool. The thermal unit consists of a receptacle containing refrigerant contained within one containing air for insulation, and a void centrally disposed into which is placed the portable dispenser. The neck of the thermal unit is constructed so that its shape and the shape of the support ledge are substantially identical. The support ledge fits snugly into the neck and forms the top of the thermal unit.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DESCRIPTION OF THE PREFERRED EMBODIMENT

Figure 1:
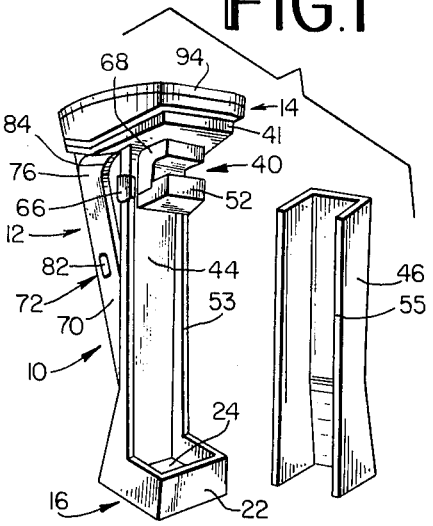
FIG. 1 shows an overall perspective view of the portable dispenser with the receptacle housing removed and standing away from it.
Figure 4:
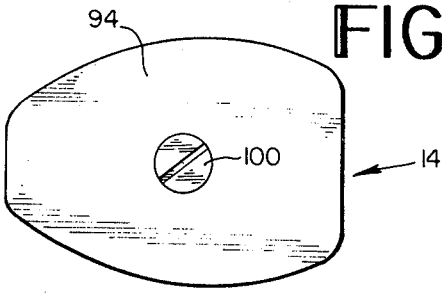
FIG. 4 shows a top view of the portable dispenser.
Figure 5:
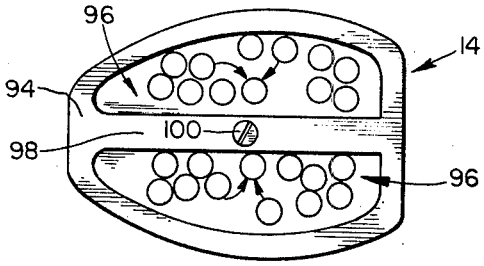
FIG. 5 shows a cross-sectional view of FIG. 2 taken on the line 5—5.

As best shown in FIG. 1, the instant invention relates to a portable dispenser generally indicated as 10 for loading, storing, cooling and cutting cube stick foodstuffs such as butter or the like. As described more fully hereinafter, the portable dispenser 10 comprises a body 12 having a top and base 14 and 16 respectively detachably attached to opposite ends thereof and a thermal unit generally indicated as 17.

Figure 11:
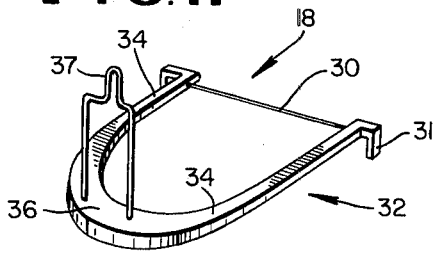
FIG. 11 shows a perspective view of the cutting element.
Figure 12:
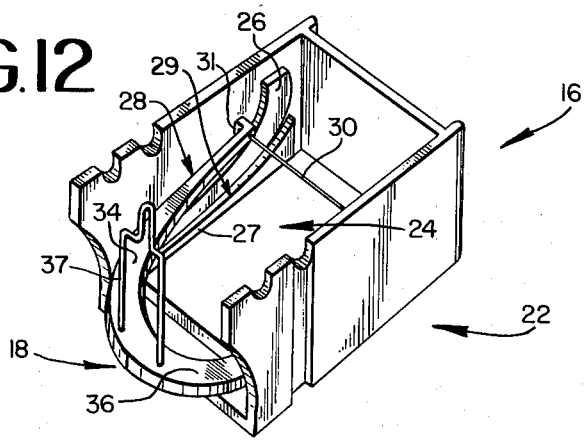
FIG. 12 shows a perspective view of the base particularly showing the cutting element guide.
Figure 7:
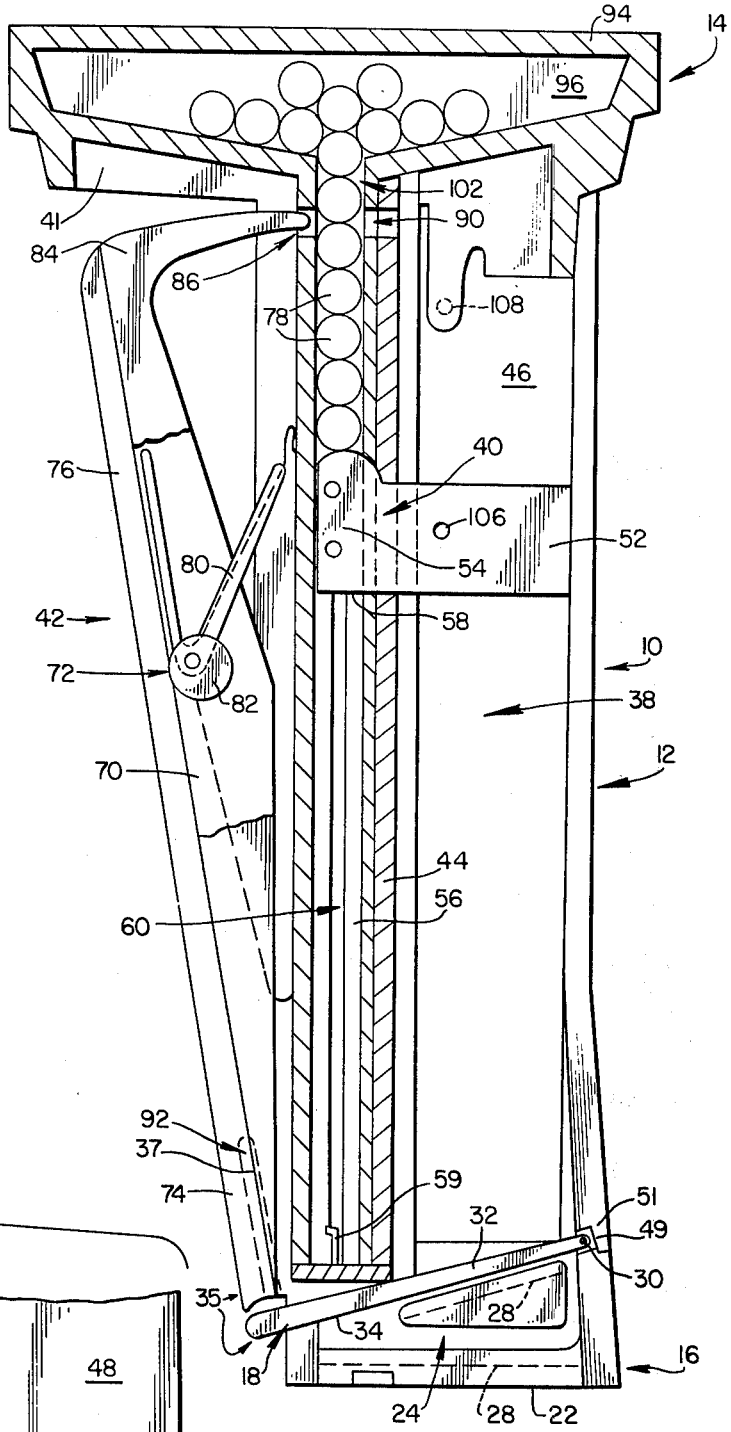
FIG. 7 shows a cross-sectional front elevation view of the portable dispenser.

As best shown in FIG. 7, the base 16 comprises a cutting element guide more fully described hereinafter, a housing 22, and a cutting aperture 24. The cutting aperture 24 comprises the open portion of the hollow housing 22 large enough for a cube stick to pass therethrough during the cutting process. The cutting element guide comprises a pair of upper guide members 26, FIG. 12, formed on opposite interior sides of the base 16, FIG. 7, which form cutting element grooves 28, FIG. 12, within each of the guide members 26, FIG. 12, and extending across the width of the cube stick; and a pair of lower guide members 27 with corresponding cutting element grooves 29. As best shown in FIG. 11, the cutting element 18 comprises a cutter wire 30 having a pair of guide elements 31 formed on opposite ends thereof and a cutter holder 32 which is comprised of a pair of substantially parallel flexible arms 34, a support member 36 and a flexible cutting element retainer 37. Opposite ends of the cutter wire 30 are attached to the forward ends of each arm 34 just aft of the guide elements 31. The opposite ends of the arms 34 are attached to the support member 36. The cutter holder 32 and the cutting element grooves 28, FIG. 12, are constructed so that the guide elements 31 will rest in the cutting element grooves 28, FIG. 12, and travel therein as the cutting element 18 travels across the cutting aperture 24 during the cutting process. The cutting element retainer 37, FIG. 11, is attached at substantially a right angle to the support member 36 at substantially the midpoint thereof.

Figure 9:
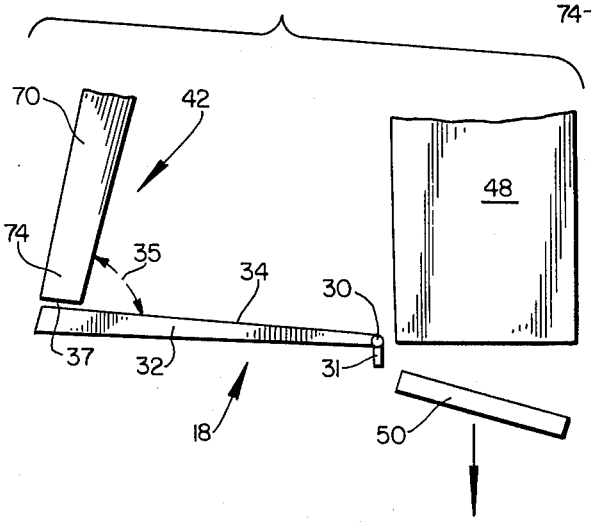
FIG. 9 shows a cross-sectional view of the cutter actuator and cutting element immediately after completion of a cut.

As best shown in FIGS. 1 and 7, the body 12 is comprised of a receptacle 38, a positioning mechanism 40, a support ledge 41, and an actuator 42. The receptacle 38 is an enclosure comprising a receptacle plate 44 which forms the rear wall of the receptacle 38 and extends the full length of the body 12 between the top and base 14 and 16 respectively, and the receptacle housing 4. The receptacle housing 46 comprises the forward and side walls of the receptacle 38 and is detachably attached to the body 12 so that its positioning relative to the receptacle plate 44 comprises four adjacent walls which substantially enclose a cube stick 48, FIG. 9, when the portable dispenser 10 is in use. The bottom of the receptacle is open and connects with the cutting aperture 24 so that the cube stick can pass down the receptacle 38 into the cutting aperture 24 where it is sliced into pats 50, FIG. 9, of convenient and pre-determined size which then fall from the bottom of the cutting aperture 24. Lower retainer ridge 49 and lower retainer lip 51 are formed on the base 16 and receptacle housing 46 respectively together with side retainer ridges 53 and side retainer lips 55 to cooperatively form a detachable lock means to permit access to the receptacle 38. Also, the apron or shield formed on the bottom of the housing maximizes sanitation and insulation in the cutting area of the dispenser. In addition, the lower portion of the receptacle housing slopes downward slightly from the front so as to form a more stable connection with the base. The slope is substantially at the same angle as the guide members 26 but slightly higher so as to form a positive path for the guide elements 31 to follow. This slope forms an indented wall on the bottom of the housing 22 to thus form a more stable connection with the base 16.

The positioning mechanism 40 comprises a pressure plate 52 which lies within the receptacle 38 and on top of the cube stick 48 during operation, a pair of pressure plate posts 54 which are located in the respective actuator tubes 56 stationed to the rear of the receptacle plate 44 and which extend the full length of the receptacle 38, and a pair of pressure plate arms 58 which connect the pressure plate 52 to the respective pressure plate posts 54. The actuator tubes 56 contain pressure plate slots 60, FIG. 7, on their sides which extend the full length of travel of the pressure plate 52. These slots 60 accommodate the pressure plate arms 58 in passing through the actuator tubes 56. These slots 60 also accommodate pins 64 which pass therethrough and attach to the pressure plate posts 54. These slots 60 are only wide enough to accommodate the pressure plate arms 58 and pins 64. These slots 60 are the same width as slots in protective walls which cover the actuator tubes 56. These pins 64, which should be small enough to ride comfortably in the slots, extend to the outside of the body 12 where they are immediately imbedded into buttons or finger holds 66. These finger holds 66 permit the manual movement of the pressure plate 52 back to the top of the portable dispenser 10 after a cube stick has been utilized and prior to the re-loading of another one.

The support ledge 41 is a ledge which substantially covers the top of the body 12 and provides a means of support for the top 14. It is fixedly attached to the body 12. Attached to the bottom of the support ledge 41 and contained within the receptacle 38 is the pressure plate release 68 which holds the pressure plate 52 at the top of the receptacle 38 while a cube stick is being loaded therein.

The actuator 42 comprises an actuator lever 70, a fulcrum 72, a cutter actuator 74, a positioning actuator 76, positioning elements 78 and actuator spring 80, FIG. 7.

The positioning elements 78 comprise spherical elements, preferably a quantity of ball bearings disposed within the actuator tubes 56 one on top of the other on top of the pressure plate posts 54. The diameter of the positioning elements 78 should be slightly less than the inside diameter of the actuator tubes 56 so that the positioning elements 78 fit snugly therein but freely movable.

The fulcrum 72 is a protrusion from the rear of the body 12 near its vertical midpoint. The actuator lever 70 is pivotally attached thereto by means of a pivot pin 82. The actuator spring 80 is held in place by means of the pivot pin 82 which applies pressure against the upper section of the body 12 as shown so that when the portable dispenser 10 is not being operated (first position) the top of the actuator lever 70 is positioned away from the body 12 and the bottom is positioned next to the body 12.

Figure 8:
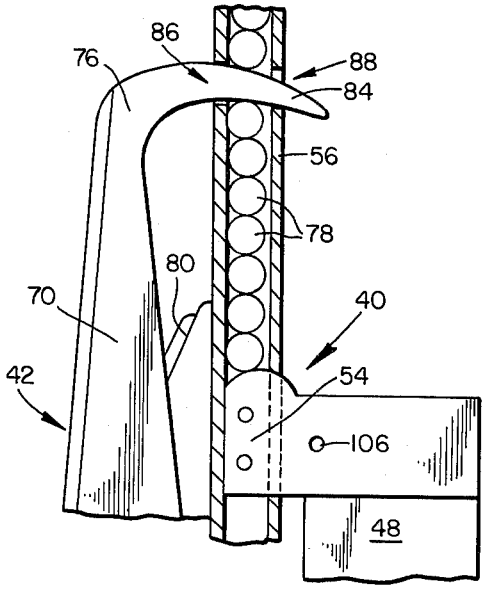
FIG. 8 shows a cross-sectional view of the positioning mechanism and positioning actuator in the middle of a cycle.
Figure 10:
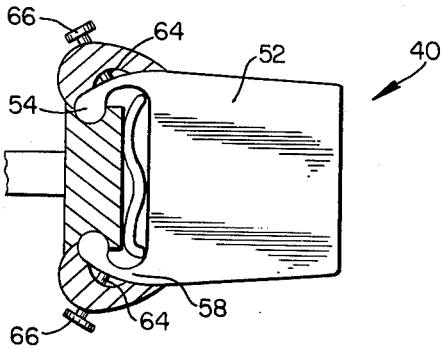
FIG. 10 shows a top view of the positioning mechanism.

The actuator lever 70, which is a lever whose fulcrum 72 is substantially near its midpoint, contains on its upper end the positioning actuator 76 and on its lower end the cutter actuator 74. The positioning actuator 76 comprises a set of prongs 84 each of which is positioned to enter the respective actuator tubes 56 when the positioning actuator 76 is pressed forward against the body 12. The prongs, 84, whose width is smaller than the inside diameter of the actuator tubes 56 but large enough to adequately perform the operations hereinafter described, are inserted into slots 86, 88, FIG. 8, and 90 respectively which are constructed in the rear and forward walls of the actuator tubes 56 and in the receptacle plate 44 as the full length of the prongs 84 is passed therethrough.

The slot 90 in the receptacle plate 44 is positioned at substantially the same height as the pressure plate release 68 and thus above the upper most travel of the pressure plate 52 so that it does not interfere therewith.

The cutter actuator 74 comprises a means of attachment of the cutting element 18 to the lower end of the actuator lever 70. The means of attachment consists of an internal passageway 92 extending vertically into the actuator lever 70 through which is passed the cutting element retainer 37 which is detachably attached therein.

The top 14 comprises a housing 94 which contains a pair of positioning element reservoirs 96 separated by a reservoir wall 98. The top 14 is positioned on top of the support ledge 41 and is detachably attached thereto by means of a screw or fastening means 100. Each positioning element reservoir is positioned over each respective actuator tube 56. Each positioning element reservoir 96 contains in the bottom thereof a reservoir aperture 102 which integrally connects with its respective actuator tube 56 so that a passageway is formed from the positioning element reservoir 96 directly into the respective actuator tube 56.

Figure 6:
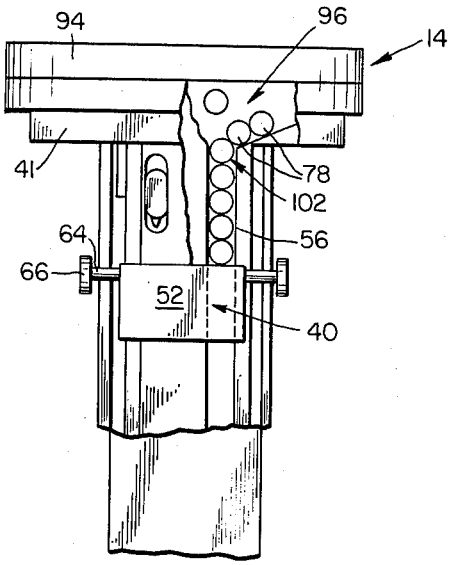
FIG. 6 shows a partial cross-sectional front view of the upper part of the body and the top.

Each positioning element reservoir 96 contains therein a plurality of positioning elements 78 whose number therein depends upon how many are contained within the respective actuator tube 56 at any given time, the total number remaining constant. The bottom of each positioning element reservoir 96, FIG. 6, is sloped toward its respective reservoir aperture 102 so that when the portable dispenser 10 is held upright as it normally is held during operation, the positioning elements 78 tend to seek gravitationally the respective reservoir aperture 102 and fall therein and into the respective actuator tube 56.

The diameter of the positioning elements 78 is substantially equal to the thickness of a pat 50 which it is desired to slice from the cube stick 48. The prongs 84 are wedge-shaped so that their heights approach zero at the tips 104. The lower portions of the prongs 84 are so constructed and shaped that when they are at the second position (completion of a cut) the points on the lower portions which are at the centers of the actuator tubes 56 are the thickness of a pat lower than the tips 104 when they were at the centers of the actuator tubes 56. Thus, a movement from first to second position pushes the positioning elements down a distance equivalent to the thickness of a pat. Furthermore, the relative height decreases at a uniform rate so that as the prongs 84 are pushed into the actuator tubes 56, the positioning elements 78 are forced down a distance uniformly equal to the corresponding downward movement of the cutter wire 30. As the prongs 84 force the positioning emechanism 40 down on the respective pressure plate posts 54. In turn the cube stick 48 is forced down by means of the pressure plate 52 pressing down on it. Both the positioning mechanism 40 and the cube stick 48, during a complete cycle, are thus forced down a distance substantially equal to the thickness of a pat 50 which it is desired to slice from the cube stick 48 and at a uniform rate proportionate to the length of travel of the prongs 84 into the respective actuator tubes 56.

The upper cutting element grooves 28 are inclined at a uniform rate from the rear to the front of the base 16 so that the drop in height is substantially equal to the thickness of the desired pat 50. At the beginning of a cutting process when the cutting element 18 and the actuator lever 70 are each in the first position, the bottom of the cube stick 48 is substantially the same height as the lower ends of the upper cutting element grooves, due to its positioning there at the end of the previous cycle. At the beginning of a cutting cycle, the cutter wire 30 is positioned at the top, forward end of the upper cutting element grooves 28 to begin a slice, and the bottom of the cube stick 48 is positioned there below the distance substantially equal to the thickness of the desired pat 50.

Because the fulcrum 72 is positioned substantially at the midpoint of the actuator lever 70, the cutter actuator 74 pulls the cutter wire 30 along the cutting element grooves 28 within the cutting element guide 20 by means of its connection to the cutting element 18 at a rate proportional to the movement of the prongs 84 into the actuator tubes 56. Therefore, the cutter wire 30 moves down at the same rate as the cube stick 48 at the same time it is cutting across the cube stick 48. Thus a pat 50 of the desired thickness is cut uniformly straight across the cube stick and drops through the bottom of the base 16 and into the appropriate container for its desired utilization.

Since the cutter actuator 74 is on one side of a fulcrum 72, its path of travel is along the circumference of a circle. The arms 34 of the cutting element 18 form an angle 35 with the cutting element retainer 37 when there is no stress on the arms 34. That is substantially the same angle which is formed between the cutter actuator 74 and the cutting element 18 at the beginning of a cycle. Therefore, whenever there is stress on the arms 34, there is a tendency to maintain angle 35. The cutting element 18 comprises a resilient or flexible material which will bend without breaking under stress and which will always seek its original position when stress is removed. In moving the cutter actuator 74 from the first to second position the cutter actuator 74 pulls the cutting element 18 across the cube stick 48, the guide elements 31 ride in the cutting element grooves 28 while there is downward pressure on the cutting element 18. At the end of the cutting process, guide elements 31 ride out of the cutting element grooves 28 and immediately spring down until the specified angle 35 is again formed. As the actuator lever 70 is released by the operator, the actuator spring 80 forces the cutter actuator 74 back to its rest position adjacent to the body 12 and base 16. The guide members 26 are constructed so that the distance between the cutting element grooves 28 and their lower edges is at least the thickness of the desired pat 50 so that during a cycle the lower edges are always lower than the bottom of the cube stick 48. As the cutting element 18 is forced back to the front of the base 16, the arms 34 ride under the lower edges of the guide members 26 while the guide elements 31 ride in the lower cutting element grooves 29, and this time, because the cutter actuator 74 is moving down and forward, pressure is exerted which tends to force the cutting element 18 to the first position. Springs 59 are located in the bottom of the actuator tubes 56 to prevent the pressure plate 52 from moving into the base 16 and to prevent damage to the portable dispenser 10. If it is desired to slice a larger pat 50, the operator merely pushes the finger holds 66 down the desired distance thus moving the cube stick 48 down that same distance.

After a cube stick 48 has been sliced, it is necessary to load another one into the portable dispenser. In preparation for this, the positioning mechanism 40 is moved back to the top of the body 12 by means of the operator manually moving the finger holds 66 up. The positioning mechanism 40 is held in place by the pressure plate release 68 by means of slits 106 on the outer surface of the pressure plate 52 into which lips 108 on the inner surface of the pressure plate release 68 snap. The pressure plate release 68 is comprised of a resilient or flexible material to permit the lips 108 to snap into the slits 106 and hold the positioning mechanism 40 against the force of gravity, but at the same time, to release the positioning mechanism 40 if positive force is supplied thereon by the positioning actuator 76.

The cube stick 48 can be picked up by the detached receptacle housing 46 without being touched by human hands. The side walls thereof are convex shaped and near the center of the walls at the point where they are nearest each other, the distance therebetween is slightly less than the width of a cube stick. Thus, when the receptacle housing 46 is placed over the cube stick 48, its side walls hold the cube stick 48 against the force of gravity. The receptacle housing 46 with its load is then press fit to the body 12 and the base 16 as previously described.

The cube stick 48 is thus held secure from gravitational effects and only moves down when the positive force of the positioning mechanism 40 overcomes the resistance of the walls of the receptacle housing 46 and forces it down.

When used in conjunction with a special package which has been developed which allows cube sticks 48 to be removed therefrom and laid bare on a surface without being touched by human hands, the result is the entire procedure from removal of the cube sticks 48 from the package to the dispensing of pats 50 occurring rapidly without the necessity of the cube sticks being touched by human hands.

Figure 3:
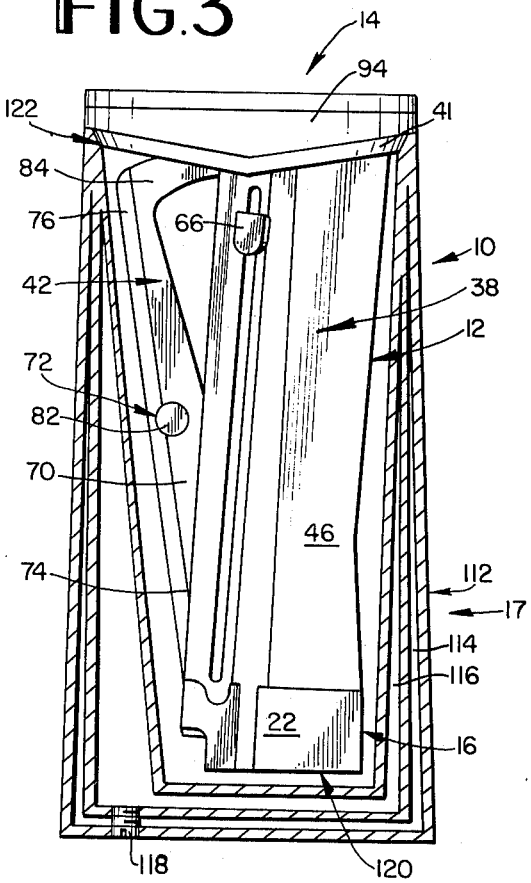
FIG. 3 shows a front elevation view of the portable dispenser housed in the thermal unit, the thermal unit shown in cross-section in a plane just forward of the portable dispenser.
Figure 2:
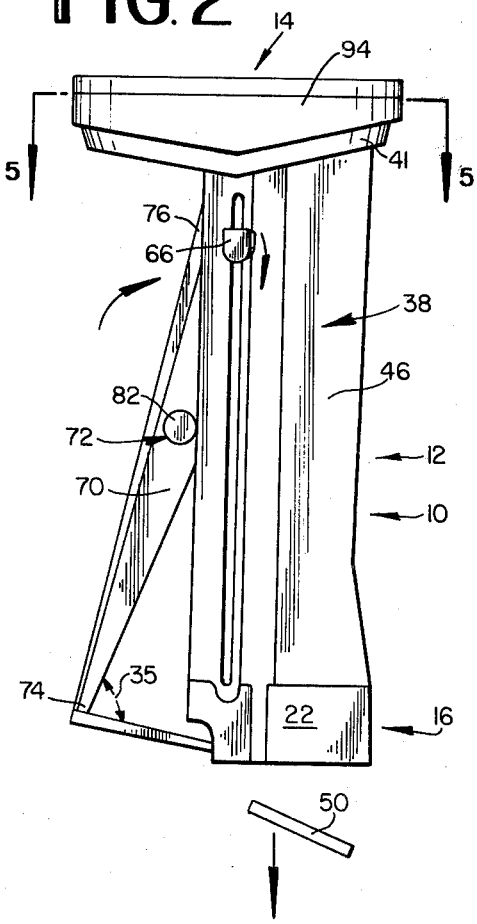
FIG. 2 shows a front elevation view of the portable dispenser with the receptacle housing attached just as a cut has been completed.

As best shown in FIG. 3, the thermal unit 112 comprises two sealed thermal receptacles 114 and 116 respectively, one disposed within the other. The outer thermal receptacle 114 contains air and thus insulates the inner thermal receptacle 116 from the atmosphere. The inner thermal receptacle 116 contains a refrigerant material such as "ice pack." The thermal receptacles 114 and 116 respectively can be manufactured in a single piece and sealed after the refrigerant is installed at the factory. Alternatively, a plug 118 can be installed between the inner receptacle 116 and the outside of the thermal unit 112 for filling of the refrigerant.

The thermal unit is constructed with a void 120 centrally located from the top so that the portable dispenser 10 can be placed therein. The thermal unit 112 further comprises a neck 122 at the top of the void 120 which is shaped substantially the same as the support ledge 41. When the portable dispenser is placed into the thermal unit 112, the close fit between the support ledge 41 and the neck 122 and the weight of the portable dispenser 10 cause the top of the thermal unit 112 to be closed securely without the necessity of any additional closing means. The void 120 is deep enough so that the portable dispenser 10 does not touch the bottom. Because the top 14 rests on top of the support ledge 41, the portable dispenser 10 can be easily removed from the thermal unit by means of the top 14.

It is readily apparent that this unique and useful portable dispenser 10 is a very sanitary device in that pats 50 of foodstuffs and the like can be dispensed easily without the cube sticks 48 ever being touched by the operator's hands. Thus, this device should be a welcome addition to the restaurant business as well as to the homes across the nation.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A portable dispenser for contents such as butter and the like comprising a body having a top and base attached at opposite ends thereof, said body including a receptacle to operatively retain the contents to be dispensed and a positioning mechanism, said base comprising a housing having a cutting aperture formed therein to receive the contents from said receptacle, a cutting element partially disposed within said cutting aperture and a cutting element guide formed on said housing, said cutting element guide extending across said base inclined at such an angle that said cutting element guide engages said cutting element as said cutting element moves from a first position to a second position, said body further comprising an actuator to simultaneously move said positioning mechanism and said cutting element to move the contents and said cutting element down at substantially the same rate as said cutting element moves across said base from said first position to said second position, the bottom of said receptacle having an aperture communication with said cutting aperture to allow said positioning mechanism to move the contents from said receptacle into said base as said cutting element is moved from said first position to said second position to cut the contents at a predetermined thickness.

2. The portable dispenser of claim 1 wherein said cutting element comprises a cutter holder including a pair of substantially parallel arms formed thereon having a cutter wire extending therebetween and means to attach said cutting element to said actuator, said cutting element being disposed relative to said housing when in said first position to be disengaged from the contents to be dispensed.

3. The portable dispenser of claim 2 wherein said cutter wire comprises a wire having a pair of guide elements attached to opposite ends of said wire and said cutting element guide comprising a pair of guide members formed on opposite sides of said base, each said guide member has a cutting element groove to operatively engage one of said guide elements, said wire being disposed to engage the contents when said cutting element moves from said first position to said second position.

4. The portable dispenser of claim 3 wherein said guide members are formed on opposite interior sides of said base, the distance between the lower edge of each said guide member and each said cutting element groove is greater than said predetermined thickness of the contents, said cutter holder comprises a substantially resilient material forming a first predetermined angle with said actuator lever when in said first position and a second predetermined angle when in said second position, said first predetermined angle such that said guide elements disengage said cutting element grooves to engage said lower edges of said guide members when said actuator and said cutting element are in said second position to return said cutting element to said first position when said actuator is in said first position.

5. The portable dispenser of claim 1 wherein said positioning mechanism comprises a pressure plate to operatively engage the top of the contents.

6. The portable dispenser of claim 5 wherein said positioning mechanism further includes at least one actuator tube disposed substantially parallel to said receptacle and extending substantially the length thereof, one pressure plate post disposed within said actuator tube, one pressure plate arm fixedly interconnecting said pressure plate post to said pressure plate, a slot formed in said actuator tube to at least partially contain said pressure plate arm, said slot extending substantially the length of said actuator tube to permit movement of said pressure plate substantially the full length of said receptacle.

7. The portable dispenser of claim 6 wherein said actuator comprises a plurality of positioning elements to be selectively disposed within said actuator tube to engage the upper portion of said pressure plate post, such that as said actuator moves from said first to said second position the lower most positioning element engages said pressure plate post to force the contents downward.

8. The portable dispenser of claim 7 wherein said positioning mechanism further includes a bias means disposed within the lower portion of said actuator tube to engage said pressure plate post to limit the downward movement thereof such that said pressure plate is held from engagement with said cutting element.

9. The portable dispenser of claim 7 wherein said top comprises at least one positioning element reservoir having a reservoir aperture formed therein, said positioning elements being in open communication with said actuator tube through said reservoir aperture such that said positioning elements are fed from positioning element reservoir to said actuator tube individually to advance the contents incrementally downward in said receptacle said predetermined thickness.

10. The portable dispenser of claim 7 wherein said positioning mechanism further comprises a finger hold attached to said pressure plate post to permit the operator to vertically adjust said pressure plate within said receptacle.

11. The portable dispenser of claim 7 wherein said positioning mechanism further includes a pressure plate release formed on the upper portion of said receptacle to engage said pressure plate to selectively retain said pressure plate at the upper portion of said receptacle.

12. The portable dispenser of claim 7 wherein said actuator further comprises an actuator lever attached to said body, a positioning actuator formed on the upper portion of said actuator lever and a cutter actuator formed on the lower portion of said actuator lever to receive said cutting element; said positioning actuator having at least one prong extending outwardly therefrom, ,said actuator tube further including a pair of apertures formed on opposite sides thereof to receive said prong when said actuator is moved between said first and said second position, the lower surface of said prong comprises a concave shape to selectively engage said positioning elements to move said pressure plate downwardly at substantially the same rate as the rate of the downward movement of said cutting element as said cutting element moves from said first position to said second position.

13. The portable dispenser of claim 12 wherein said actuator lever is disposed on a fulcrum such that said cutter actuator is disposed toward said base and said positioning actuator is disposed away from said actuator tube when said cutting element is in said first position, and said positioning actuator is disposed toward said actuator tube when said cutting element is in said second position.

14. The portable dispenser of claim 13 wherein said actuator further includes a means to bias said actuator to said first position.

15. The portable dispenser of claim 1 wherein said receptacle comprises a receptacle plate, a receptacle housing, and a means for detachably attaching said receptacle housing to said receptacle plate substantially enclosing the contents therein, said receptacle housing comprising three convex walls to securely engage the contents therebetween.

16. The portable dispenser of claim 1 further including a thermal unit comprising an inner and outer concentric sealed container, said outer container retaining an insulating material and said inner container retaining a refrigerant, a cavity substantially in the center thereof to receive said portable dispenser having a neck formed at the top of said cavity; said body of said portable dispenser further comprising a support ledge disposed beneath said top and shaped in substantially the same configuration as said neck to form a seal fit with said neck when said portable dispenser is placed into said thermal unit.

* * * * *